US009463563B2

(12) United States Patent
Takeuchi et al.

(10) Patent No.: US 9,463,563 B2
(45) Date of Patent: Oct. 11, 2016

(54) IMPACT TOOL

(71) Applicant: MAKITA CORPORATION, Anjo-shi, Aichi (JP)

(72) Inventors: Hajime Takeuchi, Anjo (JP); Masanori Furusawa, Anjo (JP); Yoshiro Tada, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 412 days.

(21) Appl. No.: 14/073,499

(22) Filed: Nov. 6, 2013

(65) Prior Publication Data

US 2014/0138111 A1 May 22, 2014

(30) Foreign Application Priority Data

Nov. 19, 2012 (JP) ..... 2012-253722

(51) Int. Cl.

*B25D 16/00* (2006.01)
*B25F 5/00* (2006.01)
*B25D 17/26* (2006.01)

(Continued)

(52) U.S. Cl.

CPC ..... *B25D 16/006* (2013.01); *B25D 17/26* (2013.01); *B25F 5/001* (2013.01); *B25D 2216/0023* (2013.01); *B25D 2217/0096* (2013.01); *B25D 2250/255* (2013.01); *B25D 2250/345* (2013.01); *B25D 2250/365* (2013.01);

(Continued)

(58) Field of Classification Search

CPC .... B25D 16/00; B25D 16/006; B25D 17/00; B25D 2211/068; B25D 2216/0023; B25D 2250/365; B25F 5/00; B25F 5/001

USPC ..... 173/47, 48, 201, 216, 217, 104, 109; 200/11 R

See application file for complete search history.

(56) References Cited

U.S. PATENT DOCUMENTS 3,837,409 A * 9/1974 Consoli ..... B25D 16/006 173/109
4,066,136 A 1/1978 Wanner et al.

(Continued)

FOREIGN PATENT DOCUMENTS

DE 44 41 793 A1 5/1996
DE 10 2009 005 248 A1 7/2010
JP A-2002-292579 10/2002

OTHER PUBLICATIONS

Feb. 14, 2014 Extended European Search Report issued in European Patent Application No. 13193209.7.

(Continued)

*Primary Examiner* — Scott A. Smith
(74) *Attorney, Agent, or Firm* — Oliff PLC

(57) ABSTRACT

It is an object of the invention to provide an improved impact tool in which a biasing member is not affected by dust.

An impact tool according to the invention has a driving mechanism 120 for driving a tool bit 119, housing parts 105, 106 that form a housing space 105*a* in which at least part of the driving mechanism 120 is disposed, and a switching member 160 for switching a drive mode of the impact tool. The switching member 160 has an operating member 161 that is operated by a user for mode switching, and a biasing member 175 that is disposed between the operating member 161 and the housing part 106 and biases the operating member 161 so as to hold the operating member 161 in a selected position. The biasing member 175 is disposed in the housing space 105*a*.

8 Claims, 7 Drawing Sheets

(51) Int. Cl.
*G05G 5/06* (2006.01)
*H01H 9/06* (2006.01)

(52) U.S. Cl.
CPC ..... *B25D 2250/381* (2013.01); *G05G 5/06* (2013.01); *H01H 9/06* (2013.01)

(56) References Cited

U.S. PATENT DOCUMENTS 5,379,848 A * 1/1995 Rauser ..... B25D 16/003 173/109
5,456,324 A * 10/1995 Takagi ..... B25D 16/006 173/109
5,842,527 A * 12/1998 Arakawa ..... B25D 16/006 173/104
6,015,017 A * 1/2000 Lauterwald ..... B25D 16/006 173/109
6,520,267 B2 * 2/2003 Funfer ..... B25D 16/006 173/170
6,712,156 B2 * 3/2004 Funfer ..... B25D 16/006 173/104
7,264,065 B2 * 9/2007 Simm ..... B25D 16/006 173/109
7,322,427 B2 * 1/2008 Shimma ..... B25D 16/006 173/48
7,469,752 B2 * 12/2008 Furusawa ..... B25D 16/006 173/170
7,549,484 B2 * 6/2009 Iwakami ..... B25D 16/006 173/104
7,708,084 B2 * 5/2010 Duesselberg ..... B25D 16/006 173/213
8,104,544 B2 * 1/2012 Ullrich ..... B25D 16/003 173/104
2002/0014343 A1 2/2002 Funfer et al.
2002/0112943 A1 8/2002 Funfer
2009/0145617 A1 6/2009 Duesselberg et al.
2010/0084151 A1 4/2010 Kuhnle et al.

OTHER PUBLICATIONS

Mar. 14, 2016 Office Action issued in Japanese Patent Application No. 2012-253722.

* cited by examiner

IMPACT TOOL

FIELD OF THE INVENTION

The invention relates to an impact tool which performs a predetermined operation on a workpiece by at least linear movement of a tool bit in its axial direction.

Cross reference is made to the Japanese patent application JP2012-253722 filed on Nov. 19, 2012 the entire contents of which are herein incorporated by reference.

BACKGROUND OF THE INVENTION

Japanese non-examined laid-open Patent Publication No. 2002-292579 discloses a mode switching mechanism for switching an operation mode of a tool bit in an impact tool. This mode switching mechanism has an operating member which is turned by a user to switch the operation mode. When the operating member is turned to select a predetermined operation mode, the operating member is positioned and held in that angular position by a biasing member. The biasing member is formed by a leaf spring fastened to a housing and holds the operating member in the selected angular position by elastically engaging with a notch (recess) of the operating member.

SUMMARY OF THE INVENTION

In the above-described known mode switching mechanism, the biasing member is disposed outside of the housing and therefore affected by dust generated during hammering operation, which impairs its durability.

It is, accordingly, an object of the invention to provide an improved impact tool in which a biasing member is protected from dust.

Above-described problem is solved by the claimed invention. According to the invention, an impact tool is provided which performs a hammering operation on a workpiece by at least linear movement of a tool bit in an axial direction of the tool bit. The impact tool has a driving mechanism for driving the tool bit, a housing part forming a housing space in which at least part of the driving mechanism is disposed, and a switching member for switching a drive mode of the impact tool. The switching member has an operating member which is operated by a user for mode switching (selection), and a biasing member which is disposed between the operating member and the housing part and biases the operating member so as to hold it in a selected position. Further, the biasing member is disposed in the housing space.

The manner of "switching the drive mode of the impact tool" in the invention represents, for example, the manner of switching the drive mode between a hammer mode in which a hammering operation is performed by striking movement of the tool bit and a hammer drill mode in which a hammer drill operation is performed by striking movement and rotation of the tool bit, or the manner of switching the drive mode between a continuous drive mode in which the operation can be continuously performed by operating a bit driving operation member to drive the tool bit and locking it in that operated position and an arbitrary drive mode in which the operation can be performed by arbitrarily operating the bit driving operation member without locking it. Further, it is preferred that the "biasing member" in the invention is typically formed by a leaf spring, but it is not limited to the leaf spring. For example, a compression coil spring or rubber can be used.

According to the invention, the biasing member which biases the operating member to hold it in the selected position is disposed in the housing space of the housing part. With such a construction, the biasing member can be protected from dust without taking troublesome measures such as covering the biasing member by a dust-proofing cover. As a result, durability of the biasing member can be improved.

According to a further embodiment of the impact tool of the invention, a lubricant for lubricating the driving mechanism is provided in the housing space, and a sealing member is provided between the housing part and the operating member. Further, an O-ring is typically used as the "sealing member" in the invention, but a packing and an oil seal other than the O-ring may be used.

According to this embodiment, the sealing member prevents the lubricant from leaking to the outside of the housing space, so that a sliding part of the driving mechanism can be reliably lubricated by the lubricant. In addition, the sealing member prevents dust from entering the housing space, so that the biasing member can be protected from dust. Further, the biasing member is disposed in the housing space and lubricated by the lubricant in the housing space, so that its wear resistance can be enhanced.

According to a further embodiment of the impact tool of the invention, the biasing member is held on a region of the housing part. In this case, the switching member is preferably provided with a fall prevention member for preventing the biasing member from falling out of the housing part.

With such a construction, the biasing member is prevented from falling out of the housing part by the fall prevention member, so that the function of the biasing member can be secured.

In a further embodiment of the impact tool of the invention, the driving mechanism has a motor, a striking element that strikes the tool bit by linear movement in the axial direction of the tool bit, and a crank mechanism that converts rotation of the motor into linear motion and then drives the striking element. The crank mechanism is disposed in the housing space.

According to this embodiment, the crank mechanism converts rotation of the motor into linear motion and can cause the tool bit to perform striking movement via the striking element.

In a further embodiment of the impact tool of the invention, an intervening member is disposed between the operating member and the biasing member. In this embodiment, a cylindrical roller or steel ball is preferably used as the "intervening member".

According to the invention, an improved impact tool is provided in which a biasing member is protected from dust. Other objects, features and advantages of the present invention will be readily understood after reading the following detailed description together with the accompanying drawings and the claims.

DETAILED DESCRIPTION OF REPRESENTATIVE EMBODIMENT OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

First Embodiment of the Invention

Figure 1:
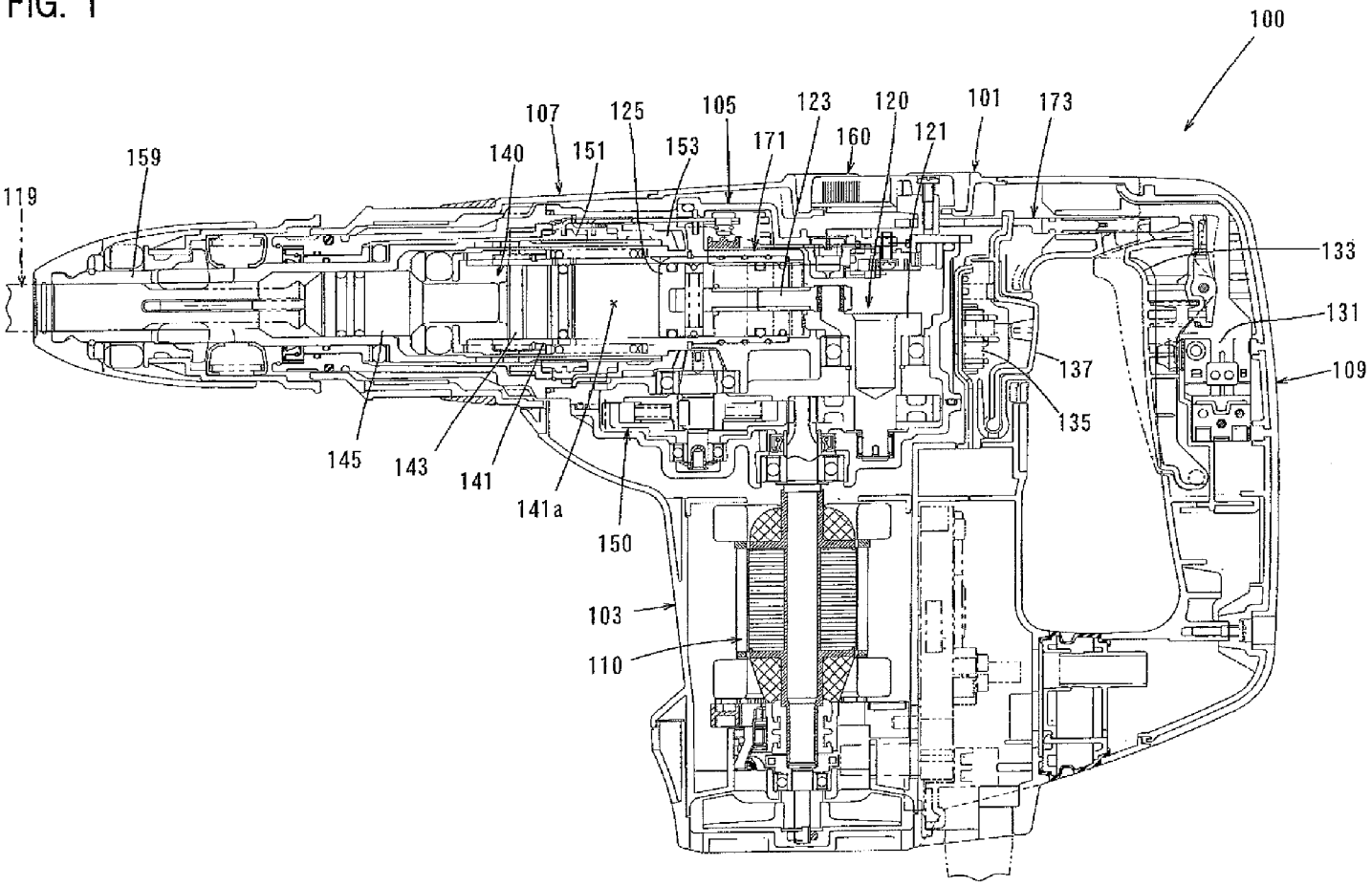
FIG. 1 is a sectional view showing an entire hammer drill according to a first embodiment of the invention.

A first embodiment of the invention is now described with reference to FIGS. 1 to 5. In this embodiment, an electric hammer drill 100 is described as a representative example of an impact tool. As shown in FIG. 1, the electric hammer drill 100 is designed as an impact tool to which a hammer bit 119 is coupled and performs drilling, chipping or other similar operation on a workpiece by causing the hammer bit 119 to linearly move in its axial direction and rotate around its axis. The hammer bit 119 is a feature that corresponds to the "tool bit" according to the invention.

The hammer drill 100 mainly includes the "tool body" in the form of a body 101 that forms an outer shell of the hammer drill 100. The hammer bit 119 is detachably coupled to a front end region of the body 101 via a cylindrical tool holder 159. The hammer bit 119 is inserted into a bit insertion hole of the tool holder 159 and held such that it is allowed to move in its axial direction with respect to the tool holder and prevented from rotating in its circumferential direction with respect to the tool holder.

A handgrip 109 is designed to be held by a user and connected to an end of the body 101 opposite from its front end region. The handgrip 109 is configured as a generally D-shaped main handle in side view which extends in a vertical direction (as viewed in FIG. 1) crossing the axial direction of the hammer bit 119 and has both ends in the extending direction connected to the body 105.

In this embodiment, for the sake of convenience of explanation, the side of the hammer bit 119 in a longitudinal direction of the body 101 is defined as the "front" or "front region" and the side of the handgrip 109 as the "rear" or "rear region". Further, an upper side of a paper plane in FIG. 1 is defined as the "upper" or "upper region" and its lower side as the "lower" or "lower region".

The body 101 mainly includes a motor housing 103 that houses an electric motor 110, a gear housing 105 that houses a motion converting mechanism 120, a striking mechanism 140 and a power transmitting mechanism 150, and an outer housing that covers the gear housing 105. The electric motor 110 is disposed such that its rotation axis (output shaft) extends in a direction generally perpendicular to the longitudinal direction of the body 101 (the axial direction of the hammer bit 119), or in a vertical direction as viewed in FIG. 1. The electric motor 110 is a feature that corresponds to the "motor" according to the invention.

The motion converting mechanism 120 appropriately converts rotation of the electric motor 110 into linear motion and then transmits it to the striking mechanism 140, and the striking mechanism 140 strikes the hammer bit 119 in the axial direction (leftward as viewed in FIG. 1).

The motion converting mechanism 120 is provided to convert rotation of the electric motor 110 into linear motion and transmit it to the striking mechanism 140, and formed by a crank mechanism which is driven by the electric motor 110 and has a crank shaft 121, a crank arm 123 and the piston 125. The piston 125 forms a driving element for driving the striking mechanism 140 and can slide in the same direction as the axial direction of the hammer bit within a cylinder 141.

The striking mechanism 140 mainly includes a striking element in the form of a striker 143 that is slidably disposed in the cylinder 141, an intermediate element in the form of an impact bolt 145 that is slidably disposed in the tool holder 159 and transmits kinetic energy of the striker 143 to the hammer bit 119. The cylinder 141 is coaxially disposed at the rear of the tool holder 159 and has an air chamber 141*a* partitioned by the piston 125 and the striker 143. The striker 143 is driven via an air spring action of the air chamber 141*a* by sliding movement of the piston 125 and then collides with the impact bolt 145 and strikes the hammer bit 119 via the impact bolt 145. The electric motor 110, the striker 143 and the crank mechanism which are described above form the "driving mechanism" according to the invention.

The power transmitting mechanism 150 mainly includes a plurality of gears and appropriately reduces the speed of rotating power of the electric motor 110 and then transmits it to the hammer bit 119 via a final shaft in the form of the tool holder 159. As a result, the hammer bit 119 is rotated in the circumferential direction.

In a power transmission path, the power transmitting mechanism 150 has an engaging type clutch 151 that transmits the rotating output of the electric motor 110 to the hammer bit 119 or interrupts the transmission. The clutch 151 is splined-fitted onto the tool holder 159 such that it can rotate together with the tool holder 159 and slide in the axial direction. One of the gears forming the power transmitting mechanism 150 or a gear 153 facing the clutch 151 has clutch teeth. When the clutch 151 is slid toward the gear 153, the clutch teeth of the clutch 151 engages with the clutch teeth of the gear 153 so that rotation of the electric motor 110 is transmitted to the tool holder 159. When the clutch 151 is slid away from the gear 153, the clutch teeth are disengaged so that transmission of rotation is interrupted. Specifically, the clutch 151 can be switched between a power transmission state in which rotation of the electric motor 110 is transmitted to the tool holder 159 and a power transmission interrupted state in which transmission of rotation is interrupted. Therefore, when the clutch 151 is switched to the power transmission state, the hammer bit 119 performs striking movement in its axial direction and rotation in its circumferential direction. Further, when the clutch 151 is switched to the power transmission interrupted state, the hammer bit 119 performs only striking movement.

An operating member for driving the hammer bit 119 is now described which is operated to drive and stop the electric motor 110. A rotary trigger 133 is provided in a grip of the handgrip 109 and serves as a first operating member for turning on and off a first switch 131. When the trigger 133 is not operated, the trigger 133 is spring-biased and held in an initial position (shown by two-dot chain line in FIG. 1) in which the first switch 131 is turned off. When the user depresses the trigger 133, the trigger 133 is rotated rearward (as shown by solid line in FIG. 1) and turns on the first switch 131. Further, a rotary lever 137 is provided in a region of the body 101 facing the grip of the handgrip 109 and serves as a second operating member for turning on and off a second switch 135. The lever 137 in its non-operating state is spring-biased and held in an initial position in which the second switch 135 is turned off. When the user pushes the lever 137, the lever 137 is rotated forward and the second switch 135 is turned on. Further, once the second switch 135 is pushed by the lever 137 and turned on, the second switch 135 is held in the on state until it is pushed again.

When both the first switch 131 and the second switch 135 which are constructed as described above are turned on, the electric motor 110 is driven. Further, when at least either one of the first switch 131 and the second switch 135 is in the off state, the electric motor 110 is stopped.

A drive mode switching mechanism 160 for switching the drive mode of the hammer drill 100 is now described with reference to FIGS. 2 to 6. As shown in FIG. 4, the drive mode switching mechanism 160 mainly includes a switching dial 161, a clutch control member 171 that controls the operating state of the clutch 151 by interlocking with user's operation of switching the switching dial 161, a switch control member 173 that controls the operating state of the switch by interlocking with user's operation of switching the switching dial 161, and a leaf spring 175 that holds the switching dial 161 in a selected position. The drive mode switching mechanism 160 and the switching dial 161 are features that correspond to the "switching member" and the "operating member", respectively, according to the invention.

As shown in FIG. 4, the gear housing 105 forms a housing space 105*a* that houses the crank mechanism, the striking mechanism 140 and the power transmitting mechanism 150. This housing space 105*a* is a feature that corresponds to the "housing space" according to the invention. The gear housing 105 has a generally rectangular opening on the top which is located generally right above the crank mechanism, and this opening is closed by a cover plate member 106 which is detachably mounted to the gear housing 105 by screws. The switching dial 161 is mounted on the cover plate member 106 such that it can rotate around a rotation axis 161*a* extending in a vertical direction crossing an axis of the hammer bit 119. In the cover plate member 106, a circular stepped hole 106*a* having a small-diameter upper part and a large-diameter lower part is formed for mounting the switching dial 161. The stepped hole 106*a* is a through hole extending in the vertical direction. The gear housing including the cover plate member 106 is a feature that corresponds to the "housing part" according to the invention.

The switching dial 161 includes a dial part 163 on which an operating grip 163*a* is formed (see FIG. 2), an upper flanged cylinder 165 disposed under the dial part 163 and a lower flanged cylinder 167 disposed under the upper flanged cylinder 165, and each of these components is separately formed. A cylindrical part 165*a* of the upper flanged cylinder 165 is fitted into the small-diameter part of the stepped hole 106*a* of the cover plate member 106 from the upper side (outer side), while a cylindrical part 167*a* of the lower flanged cylinder 167 is fitted into the large-diameter part of the stepped hole 106*a* from the lower side (inner side). In this state, the upper and lower flanged cylinders 165, 167 are connected to each other by a screw 166. Thus, the upper flanged cylinder 165 and the lower flanged cylinder 167 are assembled to the cover plate member 106 such that they are prevented from coming off from the cover plate member 106 and can rotate around the rotation axis 161*a*.

The dial part 163 of the switching dial 161 is connected to a flange 165*b* of the upper flanged cylinder 165 by a screw 164 through an opening of an outer housing 107 which covers the gear housing 105, and the dial part 163 is disposed on the upper surface of the body 101 or outside the outer housing 107 such that the user can turn it.

An O-ring 113 is disposed between mating surfaces of the cylindrical part 165*a* of the upper flanged cylinder 165 and the small-diameter part of the stepped hole 106*a*. The O-ring 113 seals a clearance between the mating surfaces so as to prevent leakage of grease out of the gear housing 105. Furthermore, the O-ring 113 applies a moderate rotational resistance to the operation of turning the switching dial 161. The grease is a feature that corresponds to the "lubricant" according to the invention. Further, an O-ring 115 is disposed between mating surfaces of the gear housing 105 and the cover plate member 106 and seals a clearance between the mating surfaces so as to prevent leakage of lubricant out of the gear housing 105. Further, other sealing members such as a packing and an oil seal may be used in place of the O-rings 113, 115.

In the hammer drill 100 according to this embodiment, the drive mode can be switched among a first hammer mode, a second hammer mode, a hammer drill mode and a neutral mode by turning the switching dial 161. In the first hammer mode, the user can perform a hammering operation (chipping operation) only by striking movement of the hammer bit 119 with the trigger 133 locked in a depressed position. In the second hammer mode, the user can arbitrarily operate the trigger 133 to perform a hammering operation only by striking movement of the hammer bit 119. In the hammer drill mode, the user can arbitrarily operate the trigger 133 to perform a hammer drill operation (drilling operation) by striking movement and rotation of the hammer bit 119. In the neutral mode, the clutch 151 of the power transmitting mechanism 150 is switched to a power transmission interrupted state, so that the user can hold the tip end of the hammer bit 119 with the fingers and adjust the orientation of the hammer bit 119 in the circumferential direction.

Figure 2:
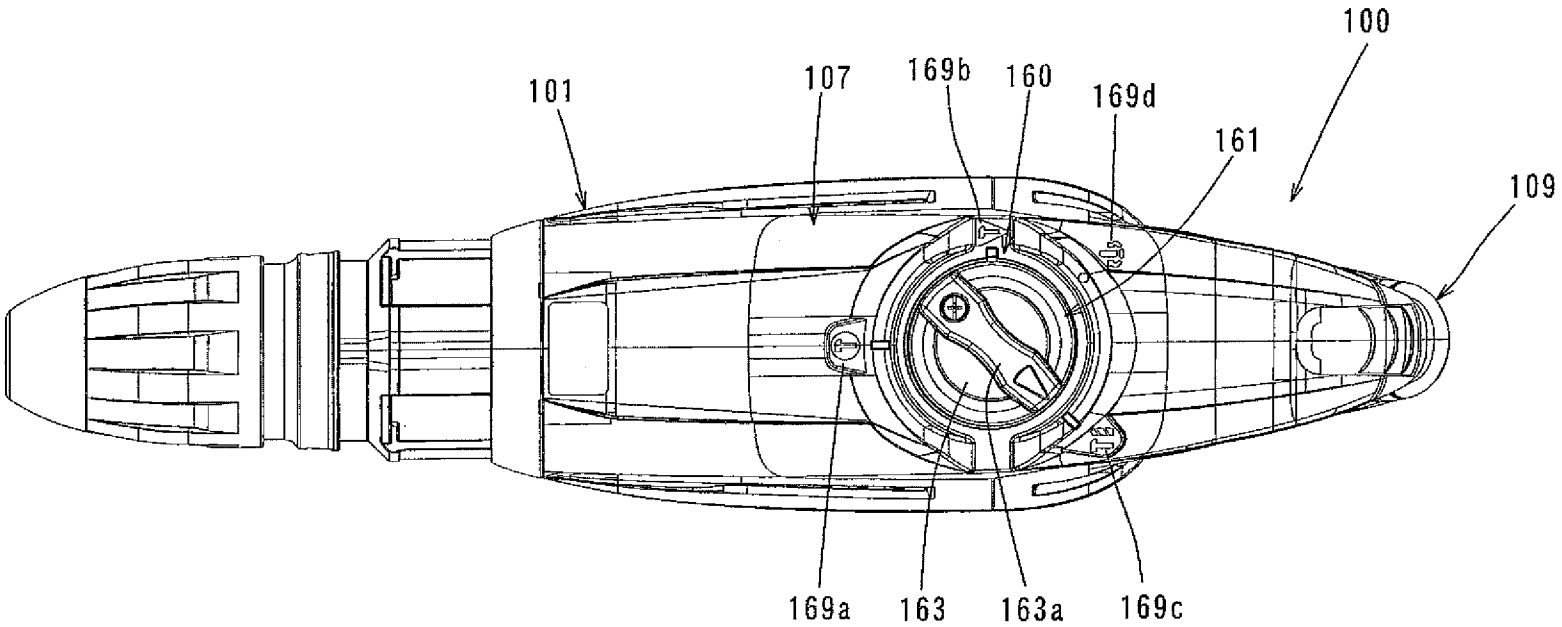
FIG. 2 is a plan view of the hammer drill showing an operating member of a mode switching mechanism.

As shown in FIG. 2, a mark 169*a* indicating the first hammer mode, a mark 169*b* indicating the second hammer mode, a mark 169*c* indicating the hammer drill mode and a mark 169*c* indicating the neutral mode (each mark shown by a picture or pictogram) are put around the dial part 163 on an outer surface of the body 101 or a top of the outer housing 107 and spaced at predetermined intervals in the circumferential direction. A desired mode is selected by turning the switching dial 161 and pointing an arrow marked on the operating grip 163*a* of the dial part 163 to one of the marks 169*a*, 169*b*, 169*c*, 169*d* indicating the desired mode.

As shown in FIG. 4, in the switching dial 161, an eccentric shaft 165*c* having a circular section is provided in a position radially displaced a predetermined distance from a rotation center 161*a* of the switching dial 161 on the flange 165*b* of the upper flanged cylinder 165 and extends upward from the upper surface of the flange 165*b*. The switch control member 173 is connected to the eccentric shaft 165*c*. The eccentric shaft 165*c* also serves as a connection part of connecting the dial part 163 to the upper flanged cylinder 165. A circular eccentric pin 167*c* is provided in a position radially displaced a predetermined distance from the rotation center 161*a* of the switching dial 161 and the clutch control member 171 is connected to the eccentric pin 167*c*.

Figure 3:
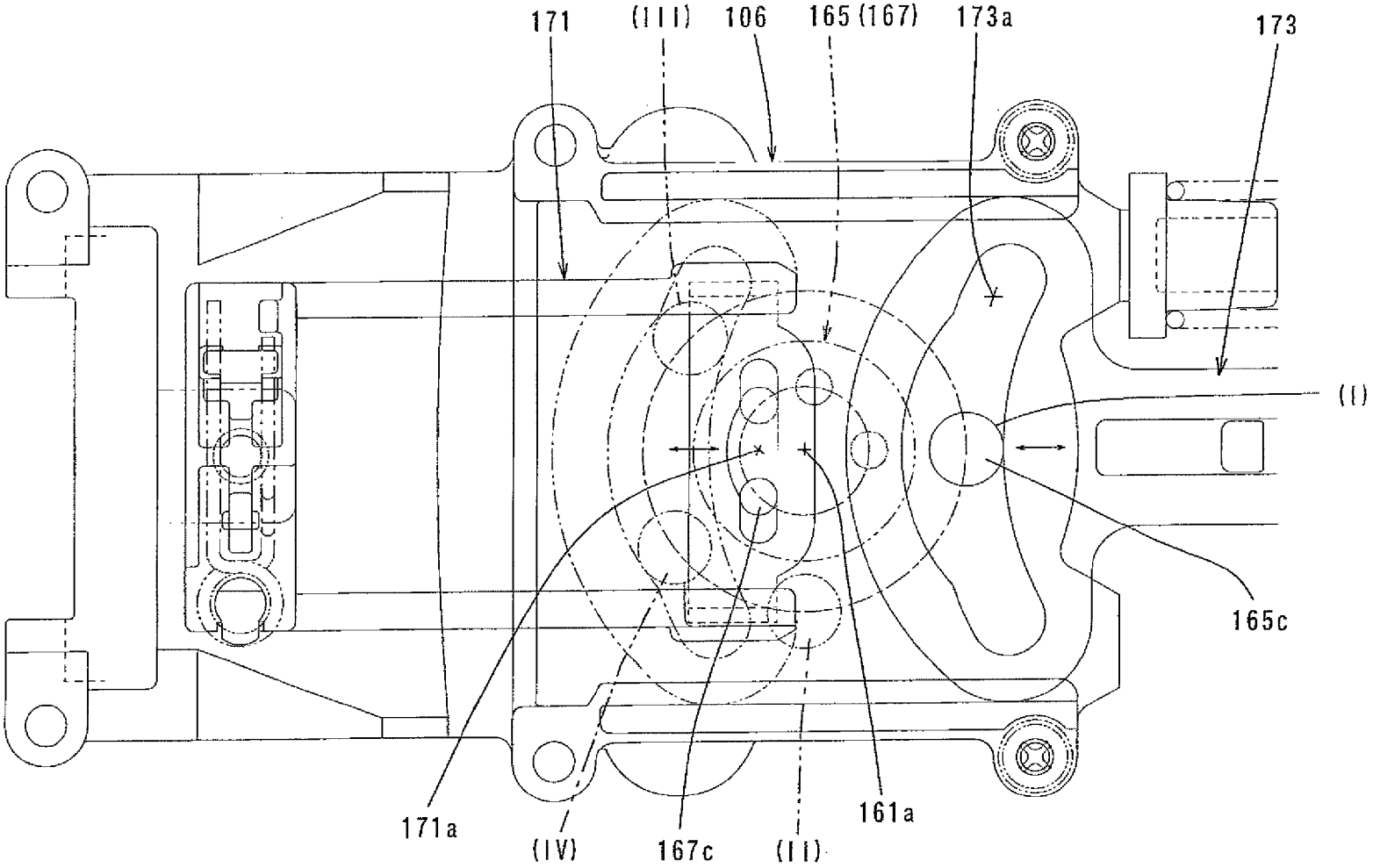
FIG. 3 is a plan view mainly showing the mode switching mechanism.
Figure 4:
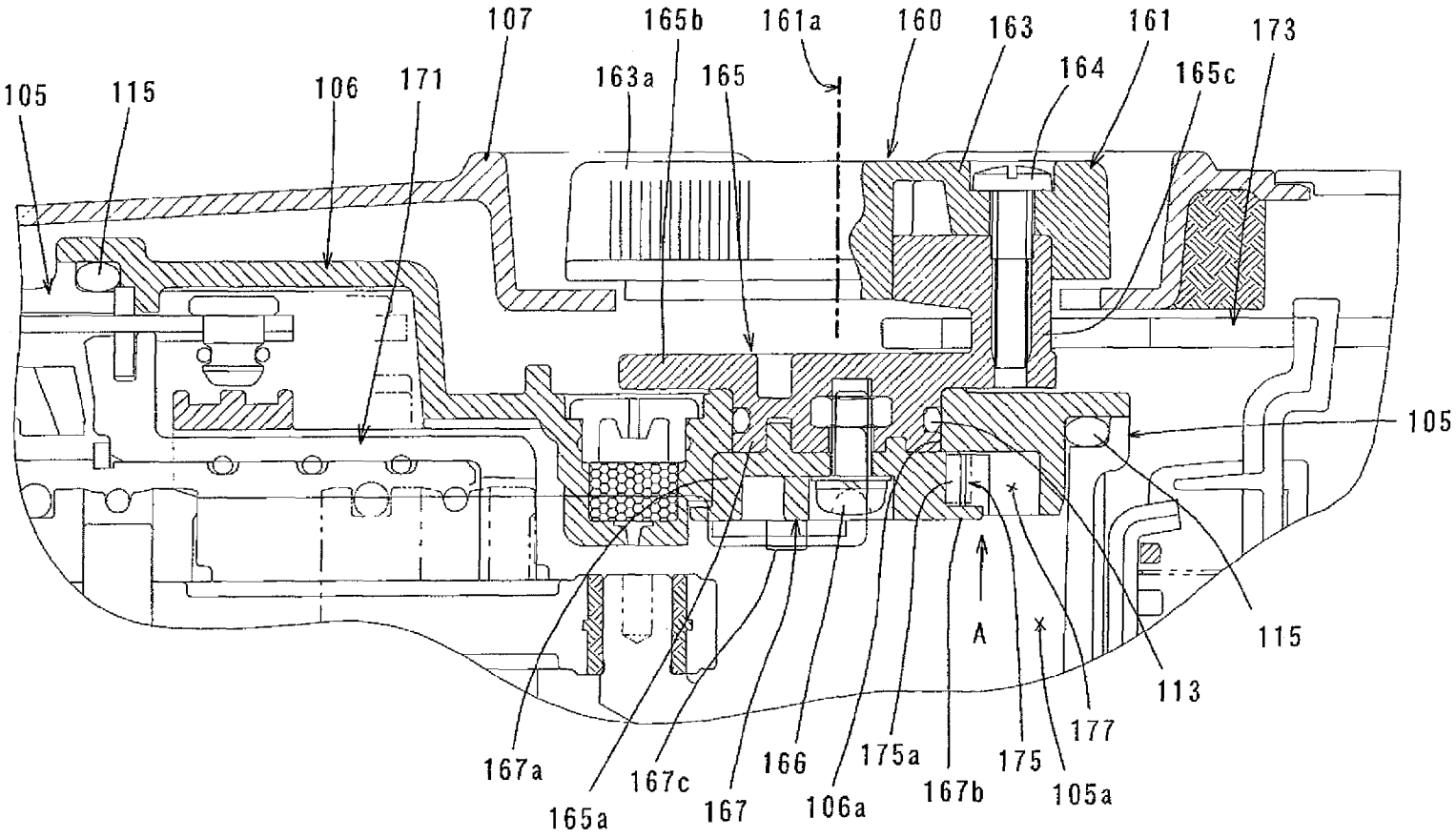
FIG. 4 is a sectional view mainly showing the mode switching mechanism.

As shown in FIGS. 1, 3 and 4, the switch control member 173 is a long member extending in the longitudinal direction (the axial direction of the hammer bit 119) and allowed to move in the longitudinal direction. The switch control member 173 is loosely connected to the eccentric shaft 165*c* via an arcuate engagement hole 173*a* (see FIG. 3) which is long in a horizontal direction (transverse direction) crossing the longitudinal direction. When the eccentric shaft 165*c* revolves, the switch control member 173 is moved in the longitudinal direction by motion components of the eccentric shaft 165*c* in the axial direction of the hammer bit (in the front-back direction). Specifically, when the switching dial 161 is switched to the first hammer mode, the switch control member 173 is moved rearward to rotate the trigger 133 rearward, and thereby turns on the first switch 131 and fixes the on state. When the switching dial 161 is switched to the second hammer mode or hammer drill mode, the switch control member 173 is moved forward to rotate the lever 137 forward, and thereby turns on the second switch 135. In FIG. 3, each position (I), (II), (III), (IV) of the eccentric shaft 165*c* corresponding to each mode is shown by solid line or two-dot chain line. The positions (I), (II), (III) and (IV) in FIG. 3 correspond to the first hammer mode, the second hammer mode, the hammer drill mode and the neutral mode, respectively.

Figure 5:
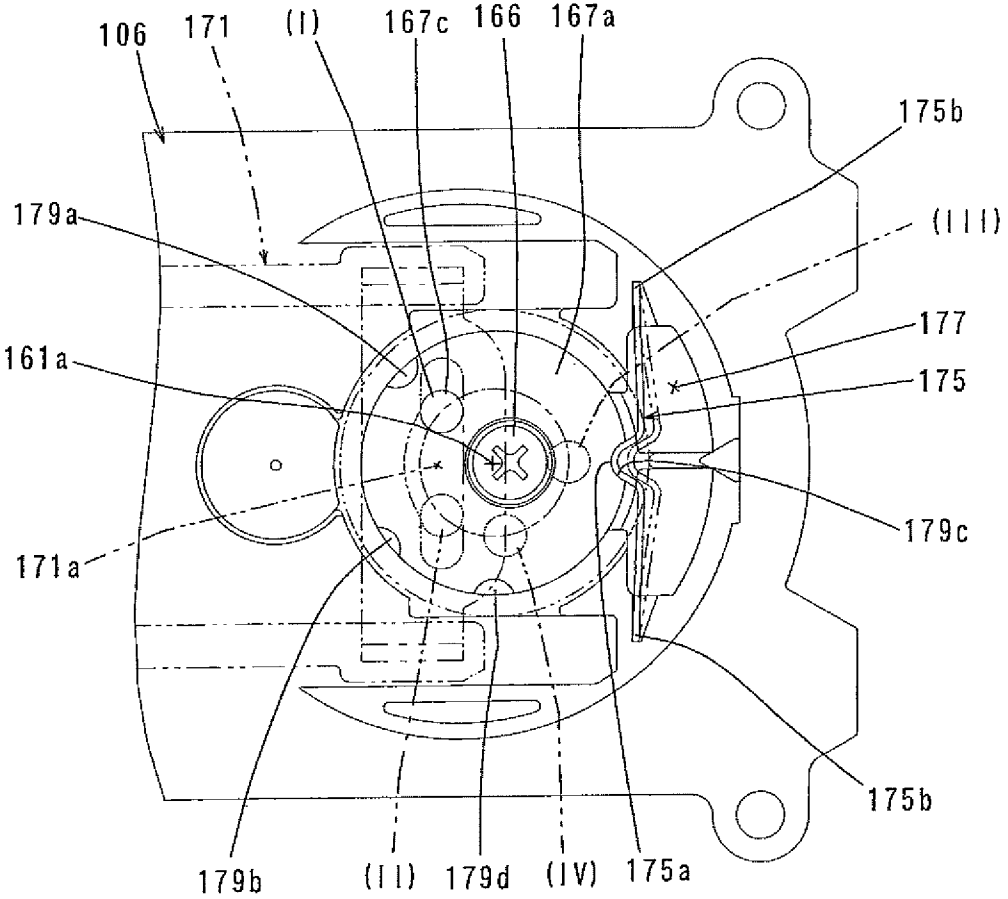
FIG. 5 is a view as viewed from the direction of arrow A in FIG. 4.

As shown in FIGS. 1, 3, 4 and 5, the clutch control member 171 is a linkage member for mechanically linking the eccentric pin 167*c* of the lower flanged cylinder 167 with the clutch 151 of the power transmitting mechanism 150. The clutch control member 171 is loosely connected to the eccentric pin 167*c* via a slot 171*a* (see FIGS. 3 and 5) which is long in a direction crossing the longitudinal direction. When the eccentric pin 167*c* revolves, the clutch control member 171 is moved in the longitudinal direction by motion components of the eccentric pin 167*c* in the axial direction of the hammer bit (in the front-back direction). Specifically, when the switching dial 161 is switched to the first hammer mode, the second hammer mode or the neutral mode, the clutch control member 171 moves the clutch 151 forward and switches it to a power transmission interrupted state in which the clutch 151 is disengaged from the clutch teeth of the gear 153. When the switching dial 161 is switched to the hammer drill mode, the clutch control member 171 moves the clutch 151 rearward and switches it to the power transmission state in which the clutch 151 is engaged with the clutch teeth of the gear 153. In FIG. 5, each position (I), (II), (III), (IV) of the eccentric pin 167*c* corresponding to each mode is shown by solid line or two-dot chain line. The positions (I), (II), (III) and (IV) in FIG. 5 correspond to the first hammer mode, the second hammer mode, the hammer drill mode and the neutral mode, respectively.

For example, when the arrow of the operating grip 163*a* is pointed to the mark 169*d* indicating the neutral mode, or the neutral mode is selected, by turning the dial part 163 of the switching dial 161, the clutch control member 171 is moved forward, so that the clutch 151 of the power transmitting mechanism 150 is switched to the power transmission interrupted state. Meanwhile, the switch control member 173 is not operated to actuate the trigger 133 and the lever 137.

Similarly, when the first hammer mode is selected by turning the dial part 163, the clutch 151 of the power transmitting mechanism 150 is switched to the power transmission interrupted state. Meanwhile, the switch control member 173 pushes the trigger 133 rearward and turns on the first switch 131. Specifically, the trigger 133 is forcibly locked in the operated position in which the first switch 131 is turned on. In this state, when the second switch 135 is turned on by pushing the lever 137 forward with the user's finger, the electric motor 110 is energized and driven. Even if the user's finger is released from the lever 137, as described above, the second switch 135 is held in the on state. Therefore, the user can continuously energize and drive the electric motor 110 without keeping pressing the lever 137 with the finger to continuously perform a hammering operation by linear striking movement of the hammer bit 119.

Similarly, when the second hammer mode is selected by turning the dial part 163, the clutch 151 of the power transmitting mechanism 150 is switched to the power transmission interrupted state via the clutch control member 171. Meanwhile, the switch control member 173 is moved forward, so that the trigger 133 is released from the lock and allowed to be operated with the user's finger. Further, the lever 137 is pushed forward to turn on the second switch 135. Therefore, the electric motor 110 is energized and driven when the trigger 133 is depressed with the user's finger to turn on the first switch 131, while the electric motor 110 is stopped when the trigger 133 is released. Specifically, in the second hammer mode, the electric motor 110 can be driven or stopped by user's arbitrary operation of the trigger 133 to perform a hammering operation by the hammer bit 119.

Similarly, when the hammer drill mode is selected by turning the dial part 163, the clutch 151 of the power transmitting mechanism 150 is switched to the power transmission state via the clutch control member 171. Meanwhile, the switch control member 173 is operated like in the second hammer mode. Specifically, the trigger 133 is released from the lock, and the lever 137 is pushed forward to turn on the second switch 135. Therefore, in the hammer drill mode, the user can drive or stop the electric motor 110 by arbitrarily operating the trigger 133 with the finger to perform a hammer drill operation by striking movement and rotation of the hammer bit 119.

In this embodiment, when the switching dial 161 is turned for mode switching, the switching dial 161 is positioned and held in the selected mode position (angular position) by the leaf spring 175. As shown in FIGS. 4 and 5, the leaf spring 175 is a biasing member which is disposed between the cylindrical part 167*a* of the lower flanged cylinder 167 and the cover plate member 106 and holds the switching dial 161 in the selected position by elastically biasing the cylindrical part 167*a* of the lower flanged cylinder 167 in the radial direction. The leaf spring 175 is a feature that corresponds to the "biasing member" according to the invention.

In the cover plate member 106, an installation space 177 for installing the leaf spring 175 is formed in a rear portion of the large-diameter part of the stepped hole 106*a*. The installation space 177 is a recess which is open on a lower (inner) side of the cover plate member 106 and on a side facing the stepped hole 106*a*, and the open lower side is open to the housing space 105*a* of the gear housing 105. The installation space 177 in which the leaf spring 175 is disposed is a feature that corresponds to the "installation space" according to the invention. A flange 167*b* of the lower flanged cylinder 167 is disposed on the open lower side in the installation space 177 (see FIG. 4). The leaf spring 175 has a linearly extending rectangular shape and is disposed in the installation space 177 such that it extends in the horizontal direction crossing the axial direction of the hammer bit 119 and can elastically deform in the longitudinal direction.

As shown in FIG. 5, extending ends 175*b* of the leaf spring 175 are prevented from moving in the longitudinal direction by a wall surface of the installation space 177. A generally semi-circular engagement protrusion 175*a* is formed in the center of the leaf spring 175 in the extending direction and protrudes forward toward the cylindrical part 167*a* of the lower flanged cylinder 167. The engagement protrusion 175*a* is elastically in contact with the cylindrical part 167*a* of the lower flanged cylinder 167 in the radial direction. A first hammer mode engagement recess 179*a*, a second hammer mode engagement recess 179*b*, a hammer drill mode engagement recess 179*c* and a neutral mode engagement recess 179*d* are formed having a generally arcuate shape in the peripheral surface of the cylindrical part 167*a* of the lower flanged cylinder 167, and the engagement protrusion 175*a* of the leaf spring 175 is selectively engaged with either one of these four engagement recesses 179*a*, 179*b*, 179*c*, 179*d*, so that the switching dial 161 is held in the selected mode position.

As shown in FIG. 4, in the leaf spring 175 disposed in the installation space 177, the engagement protrusion 175*a* is supported from below by the flange 167*b* of the lower flanged cylinder 167. Specifically, the flange 167*b* serves as a supporting member for supporting the leaf spring 175. With such a construction, the leaf spring 175 can be prevented from falling out of the installation space 177 into an internal space of the gear housing 105. The flange 167*b* of the lower flanged cylinder 167 is a feature that corresponds to the "fall prevention member" according to the invention and the "large-diameter portion" in the embodiment.

When the switching dial 161 is turned, the leaf spring 175 constructed as described above elastically deforms in the longitudinal direction, so that the engagement protrusion 175*a* is engaged with or disengaged from either one of the engagement recesses 179*a*, 179*b*, 179*c*, 179*d* which are formed in the cylindrical part 167*a* of the lower flanged cylinder 167. By such provision of elastic engagement of the leaf spring 175, moderation feeling (click feeling) can be obtained in the operation of switching the switching dial 161.

According to this embodiment, the leaf spring 175 is disposed in the installation space 177 on the inner side of the cover plate member 106 which rotatably supports the switching dial 161, or disposed inside the gear housing 105 that houses the crank mechanism, etc. With this construction, the leaf spring 175 can be protected from dust generated during operation. As a result, durability of the leaf spring 175 can be improved.

Lubricant is filled in the gear housing 105 to lubricate the crank mechanism, etc. In this embodiment, with the construction in which the O-ring 113 is disposed between the upper flanged cylinder 156 and the cover plate member 106, the lubricant can be prevented from leaking to the outside of the gear housing 105. Particularly, in this embodiment, the leaf spring 175 is disposed inward relative to the O-ring 113 or inside the cover plate member 106. With this construction, due to the effect of preventing entry of dust by the O-ring 113, the leaf spring 175 can be further reliably protected from dust. At the same time, the leaf spring 175 is lubricated by the lubricant within the gear housing 105, so that its wear resistance is enhanced.

Further, in this embodiment, the leaf spring 175 disposed in the installation space 177 of the cover plate member 106 is supported from below by the flange 167*b* of the lower flanged cylinder 167 of the switching dial 161. With this construction, the leaf spring 175 can be prevented from falling out of the installation space 177.

Second Embodiment of the Invention

Figure 6:
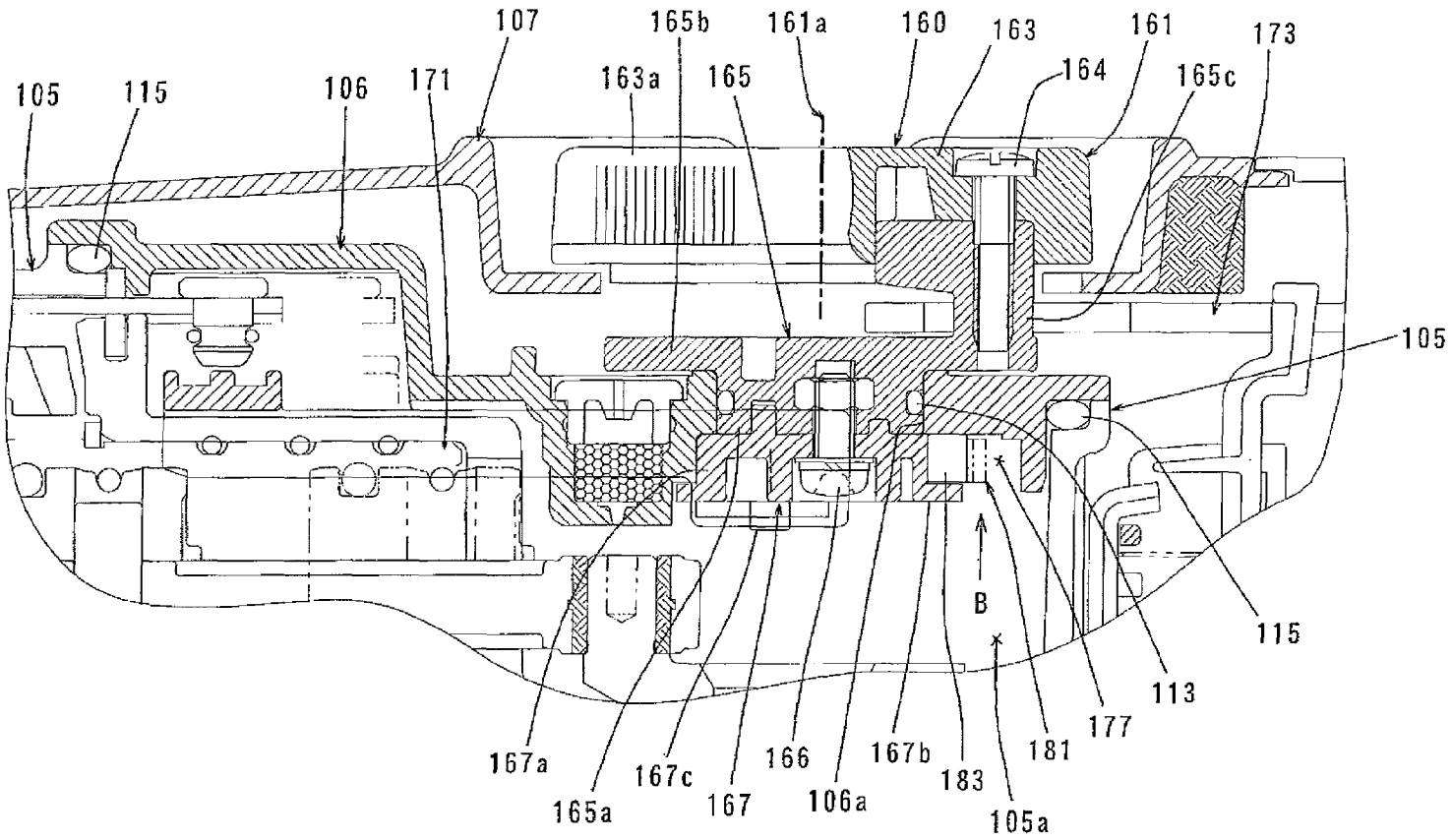
FIG. 6 is a sectional view mainly showing the mode switching mechanism.

A second embodiment of the invention is now described with reference to FIGS. 6 and 7. This embodiment is a modification to a holding means for holding the switching dial 161 in a selected position. In the other points, this embodiment has the same construction as the above-described first embodiment. Therefore, components or elements which are substantially identical to those in the first embodiment are given like numerals and are not described or only briefly described.

In this embodiment, a cylindrical roller 183 is disposed as an intervening member between a leaf spring 181 and the lower flanged cylinder 167 of the switching dial 161. The leaf spring 181 and the roller 183 are features that correspond to the "biasing member" and the "intervening member", respectively, according to the invention.

Figure 7:
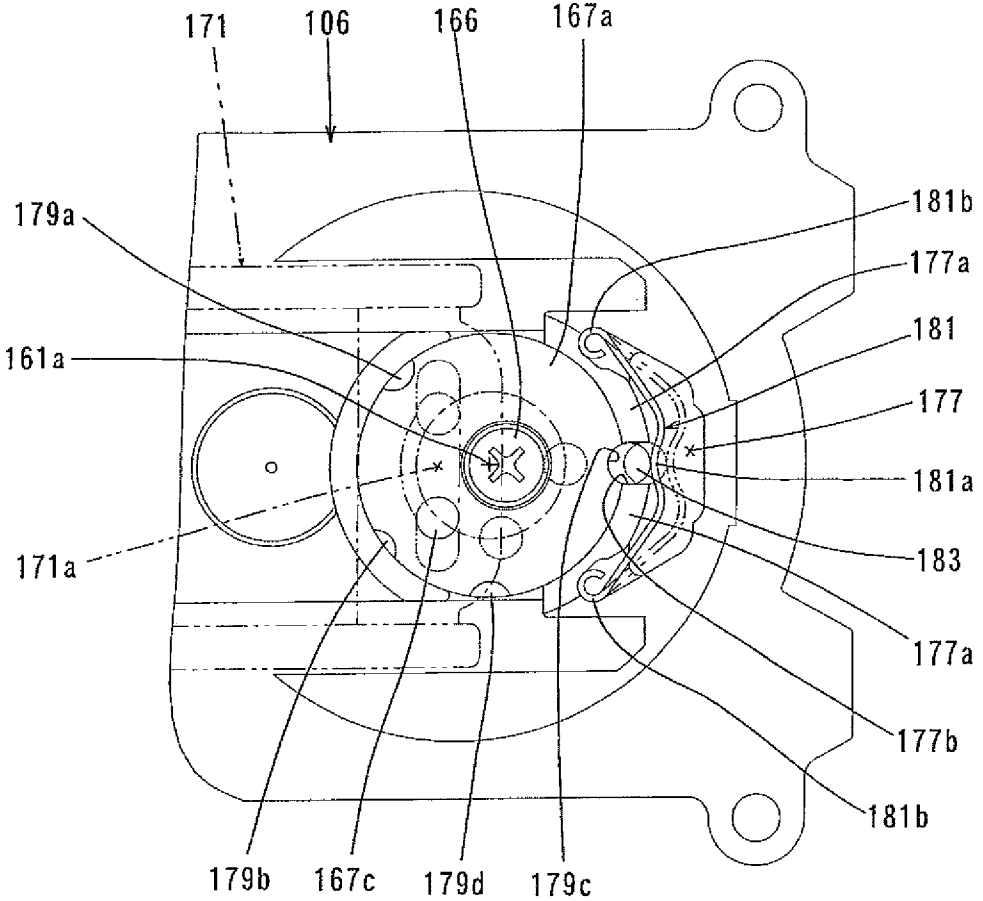
FIG. 7 is a view as viewed from the direction of arrow B in FIG. 6.

As shown in FIG. 7, the leaf spring 181 has a generally arcuate shape protruding rearward, having a convexly forward curved central portion and ring-shaped ends in its longitudinal direction. The leaf spring 181 is disposed in the installation space 177 of the cover plate member 106 such that it extends in the horizontal direction crossing the axial direction of the hammer bit 119, and can elastically deform in the longitudinal direction. Further, ring-like parts 181*b* on the ends of the leaf spring 181 are prevented from moving in the longitudinal direction by the wall surface forming the installation space 177.

The roller 183 is shaped in a cylindrical form having an outer diameter corresponding to the size of the generally arcuate engagement recesses 179*a*, 179*b*, 179*c*, 179*d* formed in the cylindrical part 167*a* of the lower flanged cylinder 167 and disposed between a central protrusion 181*a* of the leaf spring 181 and the peripheral surface of the cylindrical part 167*a* of the lower flanged cylinder 167. Therefore, when the switching dial 161 is turned, the roller 183 engages with either one of the engagement recesses 179*a*, 179*b*, 179*c*, 179*d* of the cylindrical part 167*a* while receiving a biasing force of the leaf spring 181, so that the switching dial 161 is held in the selected position.

In this embodiment, a front wall 177*a* is formed in front of the installation space 177 and provided with a guide groove 177*b* which allows the roller 183 to move in the longitudinal direction. Further, the roller 183 is prevented from moving upward by the cover plate member 106 and supported in this state from below by the flange 167*b* of the cylinder 167. By provision of this construction, when the switching dial 161 is turned, the roller 183 disposed between the leaf spring 181 and the cylindrical part 167*a* is moved in the longitudinal direction and engaged with or disengaged from the engagement recesses 179*a*, 179*b*, 179*c*, 179*d*, while receiving the biasing force of the leaf spring 181.

In this embodiment, with the construction in which the roller 183 is disposed between the leaf spring 181 and the cylindrical part 167*a*, the shape of the leaf spring 181 can be made simpler. Specifically, the leaf spring 181 can be formed to have a sectional shape having gentler irregularities to avoid stress concentration, so that durability of the leaf spring 181 can be improved. Further, the other effects of this embodiment, such as the effect of protecting the leaf spring 181 from dust, are identical to those of the above-described first embodiment.

In the above-described embodiments, the biasing member is formed by the leaf spring 175 or 181, but rubber can also be used in place of the leaf spring. In the case of a construction like the second embodiment in which the roller 183 is provided between the leaf spring 181 and the cylindrical part 167*a*, a compression coil spring may be used in place of the leaf spring, or a steel ball may be used in place of the roller 183.

In the embodiments, the hammer drill is described as a representative example of the impact tool, but the invention may be applied to a hammer which causes the hammer bit 119 to perform only striking movement in the axial direction.

In view of the above-described aspect of the invention, following features can be provided.

(1)

"The impact tool as defined in claim 1, wherein the housing part is provided with a through hole through which the operating member is inserted, the operating member has a large-diameter portion having a larger diameter than the through hole, and the large-diameter portion is disposed in the housing space and supports the biasing member."

According to this embodiment, by provision of the construction in which the biasing member is supported by the large-diameter portion, the biasing member can be prevented from falling out of a predetermined installation position.

(2)

"The impact tool as defined in (1), wherein an O-ring is disposed between the operating member and the through hole."

According to this embodiment, the O-ring prevents dust from entering through a clearance between the operating member and the through hole, so that the biasing member can be protected from dust.

(Correspondences Between the Features of the Embodiments and the Features of the Invention)

The relationship between the features of the embodiments and the features of the invention and matters used to specify the invention are as follows. Naturally, each feature of the embodiments is only an example for embodiment relating to the corresponding matters to specify the invention, and each feature of the invention is not limited to this.

The gear housing 105 and the cover plate member 106 are features that correspond to the "housing part" according to the invention.

The hammer bit 119 is a feature that corresponds to the "tool bit" according to the invention.

The crank mechanism, the electric motor 110, and the striker 143 are features that correspond to the "driving mechanism" according to the invention.

The drive mode switching mechanism 160 is a feature that corresponds to the "switching member" according to the invention.

The switching dial 161 is a feature that corresponds to the "operating member" according to the invention.

The leaf springs 175, 181 are features that correspond to the "biasing member" according to the invention.

The flange 167*b* of the lower flanged cylinder 167 is a feature that corresponds to the "fall prevention member" according to the invention.

The electric motor 110 is a feature that corresponds to the "motor" according to the invention.

The striker 143 is a feature that corresponds to the "striking element" according to the invention.

The roller 183 is a feature that corresponds to the "intervening member" according to the invention.

The housing space 105*a* of the gear housing 105 and the installation space 177 of the cover plate member 106 are features that correspond to the "housing space" according to the invention.

DESCRIPTION OF NUMERALS

100 hammer drill (impact tool)
101 body
103 motor housing
105 gear housing (housing part)
105*a* housing space
106 cover plate member (housing part)
106*a* stepped hole (through hole)
107 outer housing
109 handgrip
110 electric motor (motor)
113 O-ring
115 O-ring
119 hammer bit (tool bit)
120 motion converting mechanism
121 crank shaft
123 crank arm
125 piston
131 first switch
133 trigger
135 second switch
137 lever
140 striking element
141 cylinder
141*a* air chamber
143 striker (striking element)
145 impact bolt
150 power transmitting mechanism
151 clutch
153 gear
159 tool holder
160 operation mode switching mechanism (switching member)
161 switching dial (operating member)
161*a* rotation axis
163 dial part
163*a* operating grip
164 screw
165 upper flanged cylinder
165*a* cylindrical part
165*b* flange
165*c* eccentric shaft
166 screw
167 lower flanged cylinder
167*a* cylindrical part
167*b* flange (large-diameter portion)
167*c* eccentric pin
169*a*-169*d* mark
171 clutch control member
171*a* slot
173 switch control member
173*a* engagement hole
175 leaf spring (biasing member)
175*a* engagement protrusion
175*b* extending end
177 installation space
177*a* front wall

177*b* guide groove
179*a*-179*d* engagement recess
181 leaf spring (biasing member)
181*a* central protrusion
181*b* ring-like part
183 roller (intervening member)

What we claim is:

1. An impact tool which is configured to perform a hammering operation on a workpiece by at least linear movement of a tool bit in an axial direction of the tool bit, comprising:

a driving mechanism for driving the tool bit, a housing part that forms a housing space in which at least part of the driving mechanism is disposed, a cover plate member that is provided in the housing space, a through hole that is provided in the cover plate member, and a switching member for switching a drive mode of the impact tool, wherein:

the switching member has an operating member that is configured to be operated by a user for mode switching, and a biasing member that is disposed between the operating member and the housing part and biases the operating member so as to hold the operating member in a selected position, the biasing member being disposed in the housing space, the operating member includes a switching dial, an upper flanged cylinder and a lower flanged cylinder, the cover plate member is sandwiched between the upper flanged cylinder and the lower flanged cylinder through the through hole, and the upper flanged cylinder and the lower flanged cylinder are connected to each other such that the upper flanged cylinder and the lower flanged cylinder are prevented from coming off from the cover plate member and can rotate around a rotation axis.

2. The impact tool as defined in claim 1, wherein a lubricant for lubricating the driving mechanism is provided in the housing space, and a sealing member is provided between the housing part and the operating member.

3. The impact tool as defined in claim 1, wherein the biasing member is held on a region of the housing part.

4. The impact tool as defined in claim 3, wherein the switching member is provided with a falling prevention member for preventing the biasing member from falling out of the housing part.

5. The impact tool as defined in claim 1, wherein the driving mechanism has a motor, a striking element that strikes the tool bit by linear movement in the axial direction of the tool bit, and a crank mechanism that converts rotation of the motor into linear motion and then drives the striking element, and wherein the crank mechanism is disposed in the housing space.

6. The impact tool as defined in claim 1, wherein an intervening member is disposed between the operating member and the biasing member.

7. The impact tool as defined in claim 1, wherein the lower flanged cylinder has a larger diameter than the through hole, and the lower flanged cylinder is disposed in the housing space and supports the biasing member.

8. The impact tool as defined in claim 7, wherein an O-ring is disposed between the operating member and the through hole.

* * * * *